US006094137A

United States Patent [19]

Rasch et al.

[11] Patent Number: 6,094,137

[45] Date of Patent: Jul. 25, 2000

[54] BOOK BINDING, MACHINE, AND METHOD FOR INCORPORATING ELECTRONIC ARTICLE SURVEILLANCE MARKER INTO A BOOK

[76] Inventors: Arnan R. Rasch, 7806 Gulfton; Brandon B. Rasch, 594 Osage, both of Houston, Tex. 77036

[21] Appl. No.: 09/064,385

[22] Filed: Apr. 22, 1998

[51] Int. Cl.[7] ..... G08B 13/14

[52] U.S. Cl. ..... 340/572.1; 340/572.2; 340/572.8

[58] Field of Search ..... 340/551, 571, 340/572, 825.54, 572.1, 572.4, 572.6, 572.8, 568.1, 568.6, 568.7, 568.8, 572.2; 235/384, 400; 335/284

[56] References Cited

U.S. PATENT DOCUMENTS

| | | | |
|---|---|---|---|
| 3,938,831 | 2/1976 | Herman | 281/29 |
| 4,881,061 | 11/1989 | Chambers | 340/568 |
| 5,260,690 | 11/1993 | Mann et al. | 340/572 |
| 5,331,313 | 7/1994 | Koning | 340/551 |
| 5,440,296 | 8/1995 | Nelson | 340/572 |
| 5,477,219 | 12/1995 | Zarembo et al. | 340/572 |
| 5,500,640 | 3/1996 | Zhou et al. | 340/572 |
| 5,625,339 | 4/1997 | Zarembo et al. | 340/551 |
| 5,745,036 | 4/1998 | Clare | 340/572 |
| 5,847,649 | 12/1998 | Collins et al. | 340/572.2 |

*Primary Examiner*—Jeffery A. Hofsass
*Assistant Examiner*—Van T. Trieu
*Attorney, Agent, or Firm*—Kent A. Rowald; Felsman, Bradley, Vaden, Gunter & Dillon, LLP

[57] ABSTRACT

A book binding in which an electronic article surveillance (EAS) marker is inserted in adhesive between a cover of a book and pages of the book is disclosed. The EAS marker is securely implanted either in the adhesive along the spine of the book or in the adhesive adjacent to the cover of the book. The EAS marker is not readily visible when viewing the book and does not interfere physically or visually with the function or enjoyment of the book. The invention also discloses a method of employing the book binding to secure a book, a machine for making the book binding, and a method of making the book binding. Information relating to the sales, ownership, and licensing status of a book or associated product can be monitored with the invention. The EAS marker of the book can be altered by authorized individuals to provided continuing security.

28 Claims, 2 Drawing Sheets

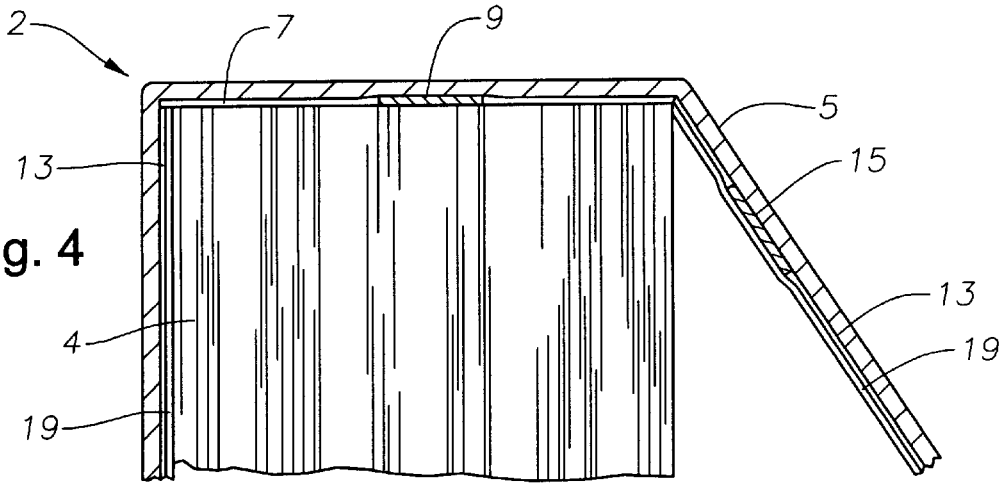
Fig. 4
Fig. 5
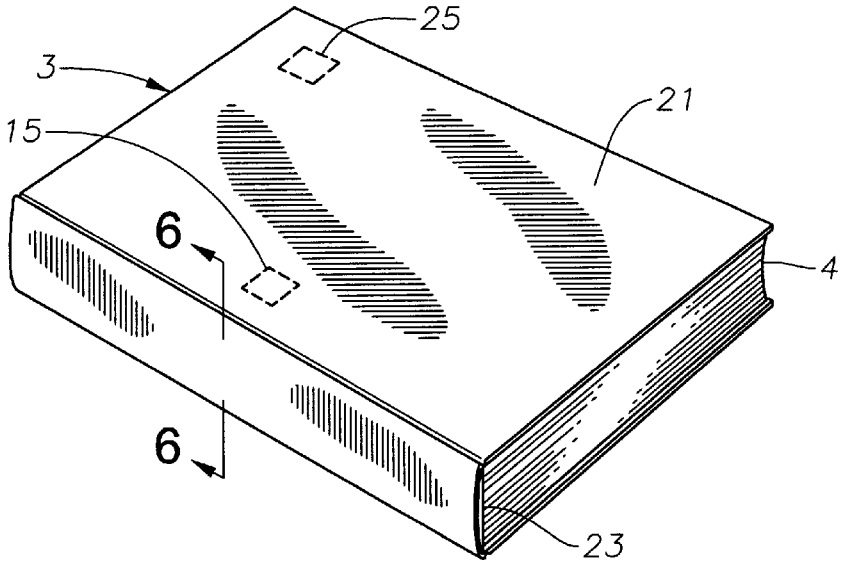
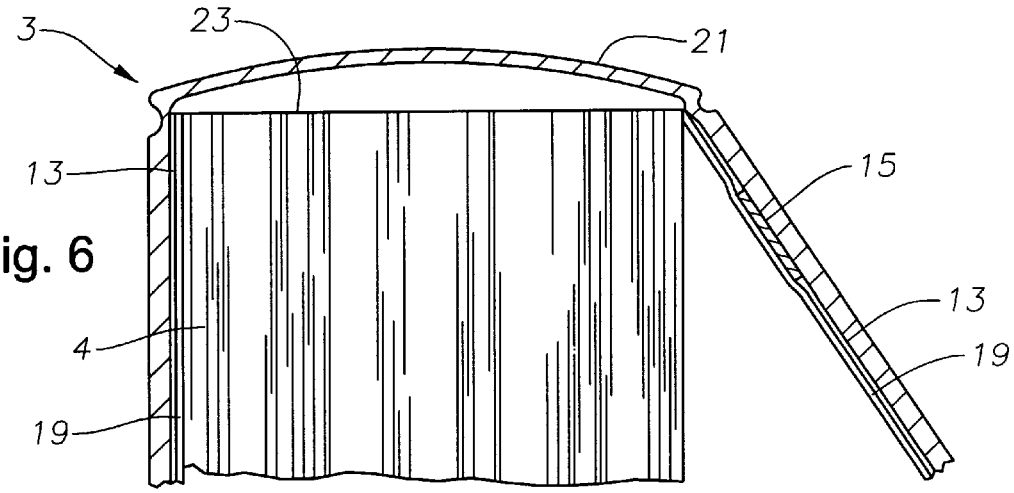
Fig. 6

BOOK BINDING, MACHINE, AND METHOD FOR INCORPORATING ELECTRONIC ARTICLE SURVEILLANCE MARKER INTO A BOOK

BACKGROUND OF THE INVENTION

1. Field of the Invention

The present invention relates to a book binding adapted to aid in the monitoring of information associated with a book. More particularly the present invention relates to a book binding that is useful in securely implanting an electronic article surveillance (EAS) marker within a book. An EAS marker can be encoded with information or configured to transpond particular information when interrogated by a signal. The invention also includes a machine for manufacturing and a method of manufacturing the book binding and a method of securing a book that employs the book binding.

2. Description of the Prior Art

Electronic article surveillance systems are widely used to monitor and secure products such as books, clothing, compact discs, and cassettes. Protecting such items against theft is one of the most common uses of EAS systems. Theft of books in particular is a concern not only for books marketed through retail establishments, but is also a concern for public and private libraries that loan books to particular individuals for limited periods of time. An increasingly important goal that can be accomplished with an EAS system is policing unauthorized copying of books. Additionally, monitoring compliance with the terms of licenses controlling the use of books and associated products can be accomplished with an EAS system.

A typical EAS system includes EAS markers attached to monitored goods and an interrogation zone or corridor through which marked goods are passed to read the information on a marker and thereby determine the status of an associated good. EAS systems can be based on magnetic, radio frequency, microwave, magneto-restrictive technologies, and other similar technologies. Regardless of what technology is employed, an EAS system is designed so that a marker will produce some characteristic response when exposed to an interrogating signal in the interrogation zone or corridor. The EAS system detects the characteristic response and initiates an appropriate security action or in some manner signals the personnel or machines monitoring the status of goods.

Electronic article surveillance markers that are attached to books are well known in the art as evidenced by U.S. Pat. No. 5,331,313 and 5,500,640. The '313 patent illustrates an adhesive marker that is specially designed to be inserted deeply between two pages of a book as close as possible to the book's spine. The '313 patent discloses that it is important to insert the marker deeply between the pages to make its application relatively permanent. Permanence is an obvious goal in placing an EAS marker. If the marker is not reasonably permanently placed, a system can be overcome merely by removing the marker. The marker of the '313 patent can, however, be removed by simply detaching the marker from a small segment of two adjacent pages of a book. At the very most it would be necessary to tear or cut away small portions of two adjacent pages in order to remove the marker.

The marker of the '313 patent necessarily binds two adjacent pages together near the spine of a book. Even if the marker is place as near as possible to the spine of a book, there will be some degradation of the use of the pages. A reader, unaware of the purpose of the marker, could also be compelled to pull the two adjoined pages apart to cause the pages to lay in the same configuration as the other pages of the book. Such separation would be liable to cause tearing of the pages of the book or detachment of the EAS marker.

The marker of the '313 patent also requires manual placement in each book secured. Therefore, even with newly manufactured books, a laborer must manually place a marker in each book. Such a method is both inefficient and costly.

The '640 patent discloses a machine for sensing elements of an EAS marker. FIGS. 2 and 3 of the '640 patent show particularly an EAS marker attached to the spine of a book. Placement in the spine is necessary for the EAS reader disclosed in the '640 patent. The marker disclosed is, however, both visible to a user of the book who might wish to remove the marker and is not so securely fastened that its removal would require any persistence. As with the '313 patent, the marker disclosed in the '640 patent is a manually installed device. Therefore, installation of the marker is less efficient and more costly than necessary.

Both the '313 and the '640 patents disclose systems that deploy markers near the spine of a book. However, in some applications it is advantageous to place a marker in a cover of a book or between the cover and an adjacent page attached to the cover. Because both patents disclose markers that are applied after a book has been manufactured, the only way to insert a marker adjacent to all areas of the cover of a book would be to cut into a cover or detach the adjacent attached page, insert a marker, and reattach the page. Such an exercise is inefficient and risks damaging components of a book.

It is evident that neither of these prior patents provides a means for securely implanting a rarely visible EAS marker into the spine or cover of a book that does not interfere with a reader's enjoyment of the book that can be attached to the book efficiently by automated production equipment.

Recently in the book publication and binding industry, certain types of books have been given additional markings and characteristics to assure the authenticity of each copy of the book. A primary example of these markings and characteristics occurs in the publication of computer software manuals. Modern computer manuals are marked with various combinations of holographic emblems, printed certificates of authenticity, interwoven identification ribbons, serial numbers, bar codes, etc. By these markings, each manual can be specifically identified and the security status of each can be controlled.

However, a problem with specifically identifying any item that is being produced is that the item has increased cost. Additionally, an item once specifically identified must be specifically tracked. In the computer software manual publication business, for example, identifying markers are incorporated into the covers of manuals before the covers are attached to the respective pages of the manuals. Therefore, during the manufacturing process, covers but not pages of manuals are specifically identified and tracked.

There are at least two disadvantages that are evident in the present process. First, during printing, shipping, binding, additional shipping, and final bundling of a manual, a number of manuals will inevitably be damaged or rejectably manufactured and will not be usable. When the process of identification occurs early in the manufacturing cycle, the seller of the manuals is required to track which identified products have been destroyed. The seller has paid to identify the products, but never is able to employ the identification means. As an example, assume that a stack of covers on a shipping pallet is damaged during transit to the book binder or that the binder erroneously cuts a number of covers. Such errors are inevitable in any manufacturing process. The seller of the books has paid for unusable covers and for identification markers that can never be fully employed. The effect of the early identification is to amplify any later mistakes that do occur. The cost of normal waste is increased.

Second, identifying markers that are applied to covers that have not yet completed all manufacturing processes are more liable to be damaged than covers without appendages. Modern cutting, binding, and sorting machinery automatically handle book covers. The machines operate at high speeds. Appendages attached to or extending from covers being handled during manufacturing are liable to cause a greater number of material handling errors.

The first two disadvantages can be avoided by saving all applications of identifying markings until the manufacturing processes have been substantially completed. However, this requires that an additional manufacturing process be added to apply identifying markers. As the art presently exists, the additional process of applying an identifying marker is inefficient and costly. Book binding companies typically do not have a machine that applies identifying marks to a completed book. If not applied by a book binding company, identifying marks must be applied by an additional vendor. Such application increases production time and increases costs. What is needed is an addition to an existing step in the present process during which an identifying marker can be easily attached to a book.

Therefore, it is easily seen that a method which generates a product that is unobtrusive to handle during manufacturing and a method that can be efficiently included in an existing manufacturing process would be superior to the present methods. A more timely applied identifying marker would not be attached until late in the manufacturing process when a product would be more likely to successfully complete the manufacturing process.

OBJECTS AND ADVANTAGES

In response to these deficiencies in the art, it is an object of the present invention to provide an improved book binding containing an electronic article surveillance (EAS) marker as well as a machine and method for producing the improved book binding that securely implants the EAS marker in a book.

It is a further object to provide an improved book binding where the EAS marker is not readily visible to a person viewing a book with the improved binding.

It is a further object to provide an improved book binding with an EAS marker that does not interfere physically or visually with a reader's enjoyment of a book with the improved binding.

It is a further object to provide an improved book binding that can receive an EAS marker in either the spine of the book binding or adjacent to a cover of the book.

It is a further object to provide an improved book binding that can be mass produced to contain an EAS marker.

It is a further object to provide an improved machine that places an EAS marker in a book binding at a time relatively near the end of the manufacturing process in order to reduce the probability that the marker will be rejected along with a book erroneously manufactured.

It is a further object to provide an improved method of securing a book by securely placing an EAS marker in adhesive between a cover of a book and a page of the book and then monitoring the information stored on the EAS marker.

It is a further object to provide an improved method of securing a book by providing an EAS marker in adhesive between a cover of a book and a page of the book that can receive and store information and that can have information altered by authorized parties to reflect the security status of the book.

Further objects and advantages of the present invention will become apparent from a consideration of the drawings and ensuing description.

SUMMARY OF THE INVENTION

The objects described above, as well as other objects and advantages are achieved by an improved book binding that accepts an electronic article surveillance (EAS) marker. The EAS marker contains information useful in maintaining surveillance over a book. The EAS marker can either be placed in the adhesive between the longitudinal edges of the pages of a book and a book cover, or the EAS marker can be placed in the adhesive between a planar surface of an outer page of a book and the book cover.

Some books are designed to be connected by adhesive that is only applied between a longitudinal edge of the pages of a book and the book cover. In a preferred embodiment of the present invention, this first type of book secures an EAS marker along the longitudinal edges of the pages of the book, i.e., along the spine of the book.

Other books are designed to be connected by adhesive applied between a longitudinal edge of the pages of the book and the book cover as well as between a planar surface of an outer page of the book and the book cover. In a second preferred embodiment this second type of binding can accommodate an EAS marker along the spine of the book and an EAS marker adjacent to the cover of the book.

In a third preferred embodiment a third type of binding is employed. The third type of binding has pages sewn into a "detached" spine of a book. This type of book has adhesive between a planar surface of an outer page of the book and a book cover. The third type of book is commonly called a library book, case book, or open back book. The binding accommodates an EAS marker in the adhesive between an outer page of the book and the cover of the book, but not along the sewn spine.

The present invention enables a method of securing a book in which an EAS marker is placed in the adhesive between the book cover and a page of the book as detailed above. The method is completed by the step of monitoring information stored on the EAS marker in order to determine the security status of the book being monitored. The EAS marker can be encoded with sales and ownership information that is used to determine the security status of a book. Additionally or in the alternative, the EAS marker can be encoded with information regarding the licensing status of a book or associated products.

An additional step may be practiced as part of the method of the present invention. Prior to monitoring information stored on the EAS marker, a user of the invention can write information to the marker. Additionally, as part of the monitoring process, the information written to the marker can be changed to reflect the appropriate sales, ownership, or licensing status of the book as the status of the book changes.

The present invention includes a machine that forms the book binding by placing an EAS marker between a page of a book and a book cover. The machine applies adhesive between the page of a book and the book cover, places an EAS marker between the page and the book cover, and brings the book cover into contact with the page or pages of the book. The machine is capable of applying adhesive to the spine of the book to produce a book of the first type described above, and is capable of applying adhesive to the spine and outer pages of the book to produce a book of the second or third types.

The practice of assembling a book binding in accordance with the present invention is described by a method of securing an EAS marker to a book by first applying an adhesive between a book cover and the pages of a book. A second step is to insert an EAS marker between the pages and the cover. A third step is to bring the book cover and the pages of a book into contact with one another where the adhesive has been applied to cause the book cover and the pages of the book to be bound to one another. Adhesive can be applied to the spine of the book only to produce a book of the first type described above, or adhesive can be applied to the spine and outer pages of the book to produce a book of the second and third types.

BRIEF DESCRIPTION OF THE DRAWINGS

In the drawings, wherein like reference characters are used throughout to describe like parts:

FIG. 4 is a cross section view taken along line 4 through the book in FIG. 3 with one cover of the book partially opened.

FIG. 5 is an isometric view of a book with a binding having adhesive between the planar surfaces of outer pages of the book and the book cover on both faces of the book.

FIG. 6 is a cross section view taken along line 6 through the book in FIG. 5 with one cover of the book partially opened.

DETAILED DESCRIPTION OF THE INVENTION

Broadly stated, there are three types of book bindings. Each type can accept an electronic article surveillance (EAS) marker as disclosed in the present invention. The first type has adhesive only between the edges of the book pages and the book cover. The second type has adhesive between the edges of the pages and the book cover and between the outer pages of the book and the book cover. The third type has adhesive between the outer pages of the book and the book cover only. In the third type of binding, pages may be sewn along their edges to a backing that is detached from the spine of the book cover.

Figure 1:
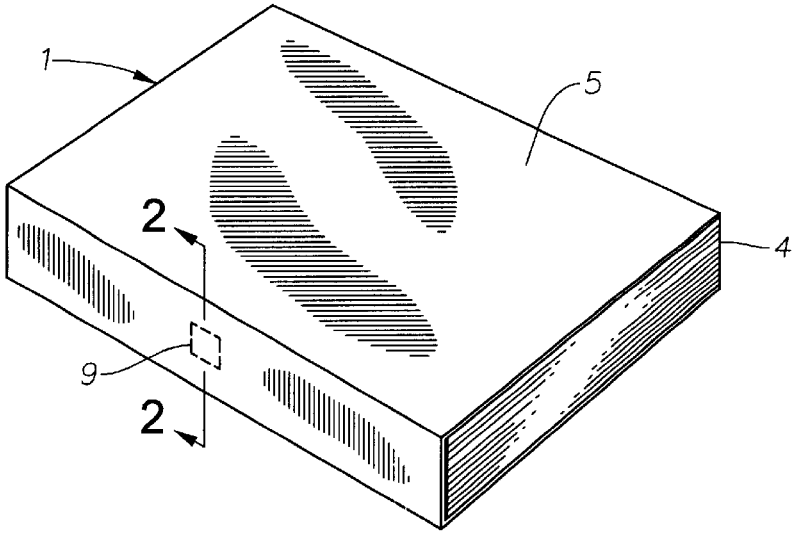
FIG. 1 is an isometric view of a book with a binding having adhesive between the longitudinal edges of the pages of the book and a book cover.
Figure 2:
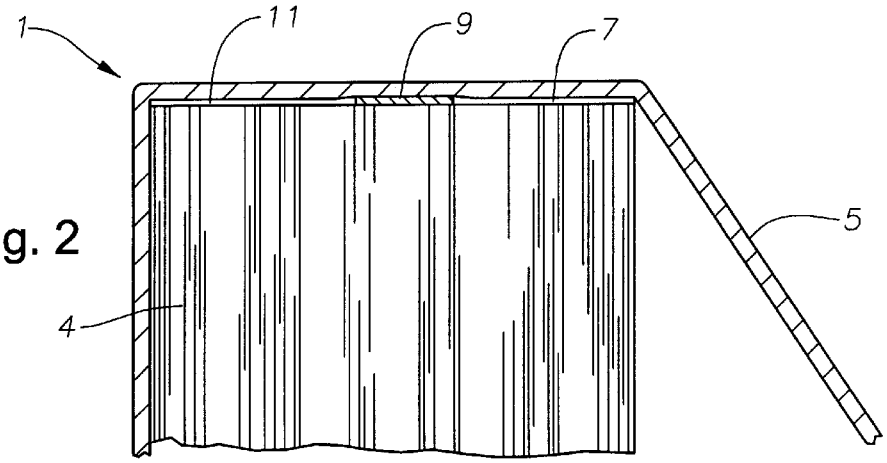
FIG. 2 is a cross section view taken along line 2 through the book in FIG. 1 with one cover of the book partially opened.

An example of the first type of book binding is shown in FIGS. 1 and 2. FIG. 2 corresponds to Section 2 taken through FIG. 1. Book 1 is constructed of pages 4, cover 5, adhesive 7, and electronic article surveillance (EAS) marker 9. Pages 4 are affixed to cover 5 by adhesive 7. Electronic article surveillance marker 9 is shown inserted in adhesive 7 between longitudinal edge 11 of pages 4 and cover 5. In this preferred embodiment, pages 4 are only connected to cover 5 with adhesive 7 applied along longitudinal edge 11 of pages 4.

Electronic article surveillance marker 9 can be any type of EAS marker that produces an informational response when read by a calibrated reader. Circuits that transpond signals when interrogated by microwave or radio signals are current technologies. Circuits that respond to an interrogation signal with multi-bit information resonations are also currently employed. Additionally, magnetic strips that can be read by various EAS readers are known. Other EAS technologies would be evident to those skilled in the art. All EAS markers now known or that will become known could be employed in the present invention. Electronic article surveillance markers 15, 17, and 25 disclosed below are functionally equivalent to EAS marker 9. Various numbers are employed to designate optional placements of EAS markers in the different embodiments.

There are a number of different types of adhesives employed in the book binding industry. The invention is not limited in application to any particular type of adhesive. In different situations, different types of adhesives are chosen. For example, a cold emulsion adhesive of polyvinyl acetate dispersed in the form of solid resins and water provides a very durable binding, but requires a relatively long drying time. A hot melt adhesive such as ethylene vinyl acetate, on the other hand, provides a less durable bond, but dries quickly and is well suited for shorter product cycles. For the purpose of the present invention, however, either type of adhesive adequately binds cover 5 to pages 4 and holds EAS marker 9 securely in place. Another type of adhesive commonly used in the industry is hot melt polyurethane resin. All of these adhesives as well as others now known and others to be discovered are well-suited to implement the present invention and are defined within the term "adhesive" as used throughout.

As illustrated in this preferred embodiment, EAS marker 9 is securely implanted in adhesive 7 between longitudinal edge 11 of pages 4 and cover 5. Additionally, EAS marker 9 is not readily visible to a person viewing the book. This placement not only makes removal of the marker difficult, but it also makes use of the book convenient. Marker 9 does not interfere physically or visually with a reader's enjoyment of a book containing an EAS marker. The marker does not physically impair the function of the book.

Figure 3:
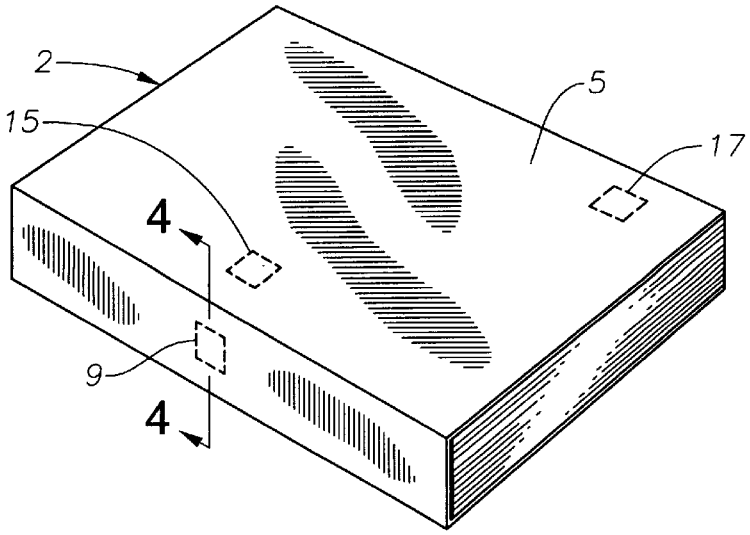
FIG. 3 is an isometric view of a book with a binding having adhesive between the longitudinal edges of the pages of the book and a book cover and having adhesive between the planar surfaces of outer pages of the book and the book cover on both faces of the book.

An example of the second type of book binding is shown in FIGS. 3 and 4. FIG. 4 corresponds to Section 4 taken through FIG. 3. Book 2 is constructed of pages 4, cover 5, adhesives 7 and 13, and EAS markers 9, 15, and 17. Pages 4 are affixed to cover 5 by adhesives 7 and 13. Electronic article surveillance marker 9 is shown inserted in adhesive 7 between longitudinal edge 11 of pages 4 and cover 5. Electronic article surveillance markers 15 and 17 are shown inserted in adhesive 13 between cover 5 and the face of outer page 19 of pages 4. Outer page 19 is also known as a planar surface of a page of book 2.

In this preferred embodiment, EAS markers may be inserted in the spine of the book binding or adjacent to a cover of the book. EAS markers may be placed at any location between cover 5 and outer pages 19 or longitudinal edge 11 of pages 4. EAS markers 9, 15, and 17 are illustrative of positions in which markers may be placed. Markers may also be placed in adhesive 13 on the opposite side of the book. Markers may need to be placed in different locations in order to be effectively read to or written on by different EAS systems. Therefore, the flexibility provided by the present invention adds to the utility of the invention.

As with book 1, the binding of book 2 provides securely implanted EAS markers that are not readily visible and do not interfere physically or visually with a reader's enjoyment of the book.

An example of the third type of book binding is shown in FIGS. 5 and 6. FIG. 6 corresponds to Section 6 taken through FIG. 5. Book 3 is constructed of pages 4, library cover 21, backing 23, adhesive 7, and EAS markers 15 and 25. Pages 4 are affixed to cover 5 by adhesive 13. Electronic article surveillance markers 15 and 25 are shown inserted in adhesive 13 between cover 5 and the face of outer page 19 of pages 4.

In this preferred embodiment, EAS markers may be inserted at any location between library cover 21 and outer pages 19. EAS markers 15 and 25 are illustrative of positions in which markers may be placed.

As with books 1 and 2, the binding of book 3 provides securely implanted EAS markers that are not readily visible and do not interfere physically or visually with a reader's enjoyment of the book.

In the various processes of binding books, there is a period between the time glue is applied to the components of the book and the time the components are assembled. The present invention utilizes this period to efficiently and effectively install EAS markers into books being bound. By installing the EAS markers during the binding process, an identification marker is being placed in a book relatively near the end of the manufacturing process. This reduces the likelihood that an installed marker will be discarded along with books rejected for not meeting manufacturing standards.

Adding an EAS marker during the binding process is an efficient use of manufacturing resources. During binding, the pages of a book are collated, aligned, and temporarily bound in a clamp. Each set of pages is prepared automatically in the manufacturing process to be mated with a cover. Adhesive is then applied to the pages or the cover, and the cover and pages are automatically bought into contact with one another. Depending on the process, the assembled pages and cover may be sent to additional machines to receive a final trimming or shaping. Between the time the adhesive is applied and the time the cover and pages are brought together, there is a unique opportunity to permanently implant an EAS marker in a book. The placement of EAS markers at that time is efficient. The cover and pages of a book are in machine accessible orientations during the opportune time. Binding machines are configured to accept multiple and various processing machines at stations of the binding machine. The present invention discloses placing in one of the stations of a binding machine a new processing machine that places an EAS marker into position between the cover and pages of a book. The new processing machine is between the station that applies adhesive and the station that brings the cover and the pages together. Therefore, while the cover and pages are accessible, a machine at a station located between the station applying the adhesive and the station bringing the cover and the pages together applies an EAS marker.

Once an EAS marker is installed in a book, the book can be secured by monitoring the information recorded on the marker. Information about the sales and ownership status of the book as well as information about the licensing status of the book and products associated with the book can be monitored. As the status of any information associated with the book changes, the invention discloses an EAS marker that is capable of being updated.

One example of an application of an EAS marker that may be updated is the computer manual example discussed above. A manual with a writable EAS marker would not even have to be specifically identified or tracked during the manufacturing process. A book binder could insert an EAS marker, but would not be required to encode the EAS marker with information. The owner of the book could write information to the EAS marker. This not only reduces the material tracking duties of all of the parties during manufacturing, but also allows the owner and eventual seller of a book with an EAS marker to control security codes and marker programming.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A book binding for accepting an electronic article surveillance (EAS) marker comprising:

a page of a book;

a book cover for covering said page;

an EAS marker on which surveillance information is stored; and an adhesive applied between said book cover and said page for securing said book cover to said page and into which said EAS marker is inserted.

2. The book binding of claim 1 wherein said book cover is connected to said page of a book with adhesive applied between a longitudinal edge of said page and said book cover.

3. The book binding of claim 2 wherein said EAS marker is secured in said adhesive between a longitudinal edge of said page and said book cover.

4. The book binding of claim 1 wherein said book cover is connected to said page of a book with adhesive applied between a planar surface of said page and said book cover.

5. The book binding of claim 4 wherein said EAS marker is secured in said adhesive between a planar surface of said page and said book cover.

6. The book binding of claim 4 wherein said book cover is connected to said page of a book with adhesive applied between a longitudinal edge of said page and said book cover.

7. The book binding of claim 6 wherein said EAS marker is secured in said adhesive between a longitudinal edge of said page and said book cover.

8. The book binding of claim 6 wherein said EAS marker is secured in said adhesive between a planar surface of said page and said book cover.

9. A method of securing a book by monitoring an electronic article surveillance (EAS) marker placed in adhesive between a book cover and a page of a book comprising the steps of:

placing an EAS marker in adhesive between a book cover and a page of a book;

monitoring information stored on the EAS marker to determine the security status of a book.

10. The method of securing a book of claim 9 wherein the EAS marker contains information about the sales and ownership status of a book.

11. The method of securing a book of claim 9 wherein the EAS marker contains information about the licensing status of a book.

12. The method of securing a book of claim 9 further comprising the step of writing security status information to the EAS marker imbedded in a book.

13. A machine for placing an electronic article surveillance (EAS) marker between a page of a book and a book cover comprising:

a means for applying adhesive between the page of a book and the book cover;

a means for placing the EAS marker between the page of a book and the book cover; and a means for applying the book cover to the page of a book.

14. The machine of claim 13 wherein the book cover is connected to the page of a book with adhesive applied between a longitudinal edge of the page and the book cover.

15. The machine of claim 14 wherein the EAS marker is secured in the adhesive between a longitudinal edge of the page and the book cover.

16. The machine of claim 13 wherein the book cover is connected to the page of a book with adhesive applied between a planar surface of the page and the book cover.

17. The machine of claim 16 wherein the EAS marker is secured in the adhesive between the planar surface of the page and the book cover.

18. The machine of claim 16 wherein the book cover is connected to the page of a book with adhesive applied between a longitudinal edge of the page and the book cover.

19. The machine of claim 18 wherein the EAS marker is secured in the adhesive between a longitudinal edge of the page and the book cover.

20. The machine of claim 18 wherein the EAS marker is secured in the adhesive between the planar surface of the page and the book cover.

21. A method of securing an electronic article surveillance (EAS) marker to a book comprising the steps of:

applying an adhesive between a book cover and a page of a book;

inserting an EAS marker between a book cover and a page of a book; and bringing the book cover and the page of a book into contact with one another to cause the book cover and the page of a book to be bound to one another by the adhesive about the EAS marker.

22. The method of claim 21 wherein the adhesive is applied between the book cover and a longitudinal edge of the page of a book.

23. The method of claim 22 wherein the EAS marker is inserted between a longitudinal edge of the page and the book cover.

24. The method of claim 21 wherein the adhesive is applied between the book cover and a planar surface of the page.

25. The method of claim 24 wherein the EAS marker is inserted between the book cover and a planar surface of the page.

26. The method of claim 24 wherein the adhesive is applied between the book cover and a longitudinal edge of the page.

27. The method of claim 26 wherein the EAS marker is inserted between the book cover and the longitudinal edge of the page.

28. The method of claim 26 wherein the EAS marker is inserted between the book cover and a planar surface of the page.

* * * * *